US005865080A

United States Patent [19]

Jackson

[11] Patent Number: 5,865,080

[45] Date of Patent: Feb. 2, 1999

[54] TRIMMER FLEXIBLE POSITIONING FENCE

[75] Inventor: James G. Jackson, Salmon Arm, Canada

[73] Assignee: Newnes Machine Ltd., Salmon Arm, Canada

[21] Appl. No.: 758,476

[22] Filed: Nov. 29, 1996

[51] Int. Cl.[6] ..... B26D 5/20

[52] U.S. Cl. ..... 83/74; 83/75.5; 83/365; 83/419; 83/425.3; 83/443; 83/446

[58] Field of Search ..... 83/72, 74, 75.5, 83/331, 360, 365, 418, 419, 420, 425.2, 425.3, 438, 443, 444, 445, 446, 448, 467.1, 732

[56] References Cited

U.S. PATENT DOCUMENTS

| | | | |
|---|---|---|---|
| 4,069,910 | 1/1978 | Faley et al. | 198/456 |
| 4,144,782 | 3/1979 | Lindstrom | 83/446 |
| 4,333,373 | 6/1982 | Blickenderfer | 83/419 |
| 4,373,563 | 2/1983 | Kenyon | 83/446 |
| 4,572,256 | 2/1986 | Rautio | 83/446 |
| 4,633,924 | 1/1987 | Hasenwinkle et al. | 83/446 |
| 4,753,335 | 6/1988 | Goater | 198/456 |
| 4,977,805 | 12/1990 | Corley, III | 83/418 |
| 5,142,955 | 9/1992 | Hale | 83/75.5 |
| 5,174,351 | 12/1992 | LIndenblatt et al. | 144/356 |
| 5,444,635 | 8/1995 | Blaine et al. | 83/75.5 |

*Primary Examiner*—Maurina T. Rachuba
*Attorney, Agent, or Firm*—Antony C. Edwards

[57] ABSTRACT

The board positioning device of the present invention selectively positions in a lateral direction in a generally horizontal plane a board translating in a longitudinal direction in the horizontal plane, wherein the board is aligned along its length in the lateral direction, and the device includes a flexible fence lying in the generally horizontal plane, a fence positioner for selectively positioning the flexible fence in the lateral direction in the generally horizontal plane along a transition path as determined by an optimizer whereby the board may be laterally selectively positioned optimally relative to trimmer saws located downstream from the flexible fence in the longitudinal direction when the board is urged laterally against the flexible fence by lateral ending rolls.

13 Claims, 6 Drawing Sheets

TRIMMER FLEXIBLE POSITIONING FENCE

FIELD OF THE INVENTION

This invention relates to the field of sawmill machinery, and in particular to board positioning fences for trimmers.

BACKGROUND OF THE INVENTION

In a typical lumber mill or planer mill, each board is moved along sideways, that is, oriented transversely on a lugged transfer prior to trimming. Typically, the lugs on the lugged transfer are evenly spaced at precise intervals. The boards are passed through an electronic scanner which determines the shape of each board and sends the shape information to an optimizer. The optimizer in turn sends the information to a controller. The controller activates saws above a trimmer saw deck to trim the board, in an attempt to maximize board utilization. Typically, however, saws are spaced about two feet apart, so that depending upon the physical end defects of a board, up to almost two feet on each end of the board can be trimmed and thus wasted, which can result in a considerable wastage of useful wood.

In order to minimize such wastage, in the prior art, board positioners have been developed which utilize a plurality of parallel rollers that are driven in a direction at right angles to the transfer deck, thus moving the ends of the boards up to a positioning fence. When on the rollers, the boards are continually thrust laterally across the transfer deck, until the board is raised above the rollers thus disengaging the board from the rollers at a predetermined time. Such prior art devices have the disadvantage that wet or icy boards will often slip on the rollers while being moved. Such slippage is exacerbated by the rapid rotational acceleration of the rollers as the rollers are accelerated to thrust, lengthwise, the boards laterally across the transfer deck. In addition, such devices suffer from the fact that tapered ends of the boards abutting the positioning fence can be so structurally weak as to collapse or break when contacting the fence. Because the board was scanned and optimized based on the inclusion of the tapered ends, if one end is broken off, the optimized lengthwise movement of the board can be overshot as the broken board is ended against the positioning fence, resulting in a board that is trimmed non-optimally.

Thus, it is the object of the present invention to provide a board positioning device which can accurately position selected boards lengthwise, and process the boards through the trimmer at a higher rate of speed than prior art devices and without substantial slippage, or collapse of the board's weak ends, to thus provide an improvement in maintaining a consistently accurate and optimally trimmed board.

Further, if the board is translated laterally by the rollers more than a small distance before the board contacts the positioning fence, the lateral velocity and acceleration of the board will often result in the board bouncing off the positioning fence. This also causes loss of accuracy in optimizing trimming of the board because the optimizer and controller regulating the lateral optimized positioning of the board relative to the saws uses positioning information based on the assumption that the board is ended closely against the positioning fence.

Thus, it is the object of the present invention to provide a board positioning device which can accurately position selected boards lengthwise, that is, transversely across the transfer deck and process the boards through the trimmer at a higher rate of speed than prior art devices and without substantial board slippage or bounce, or collapse of the board's weak ends, to thus provide an improvement in maintaining a consistently accurate and optimally trimmed board.

SUMMARY OF THE INVENTION

By way of brief overview, a flexible lumber or board positioning fence has a plurality of consecutive and offset, flexible positioning fences, mounted upstream of a trimmer in the direction of board flow. The boards move through a scanner for optimization, then on to a transfer table, where they are translated on lugged transfer chains, and co-extensively simultaneously translated over a plurality of ending rolls mounted parallel to the lugged transfer chains. The ending rolls urge the boards laterally against a first flexible positioning fence, where the first positioning fence has been selectively deformed, as by selective curvature of the surface of the fence in the horizontal plane containing the board into its optimized position as determined by an optimizer.

The boards are translated both in a lateral direction towards the flexible fence or fences and simultaneously longitudinally towards the trimmer saw blades. The flexible fence or fences are adapted to contact the end of the board softly to prevent bouncing of the boards off the fence or the breaking and loss of a structurally weak end of the board and, consequently to prevent missed target points on the board which have been set by the optimizer as sawing points based both on a scanned board profile which included the structurally weak end, and on the assumption. the board is ended snugly against the fence.

The board is left in contact with the ending rolls until the board has reached its optimized lateral position. The board optimized lateral position can fall within the range of movement of the first fence if the board needs only a short segment trimmed, or can fall within the combined ranges of movement of two or more of successive fences if the board needs a longer segment trimmed. At the point that the board reaches its optimized lateral position, it is lifted slightly above the ending rolls by successive rows of selectively elevatable skids so as to prevent further lateral movement of the board as it nears the trimmer.

Information from the scanner is sent from the scanner to the optimizer, which calculates the optimum trimming position for each board based on the measured data. The optimized trimming position for each board is then sent to a controller which controls the positioning of the flexible positioning fences. The flexible positioning fences are mounted successively downstream adjacently one after the other in the direction of flow of the boards. Each successive flexible fence is offset further out from the lumber line along the direction of flow of the boards.

The ending rolls urge the lumber against the array of adjacent flexible positioning fences. The positioning fences are deformed by being selectively actuably curved in a plane containing the boards into their optimized positions as is determined by the optimizer. The ending rolls may have a treated or otherwise friction enhancing surface to increase the surface friction so as to better control the lateral movement of the boards. Also, the lugs on the transfer chains may be equipped with rollers for contacting the boards so as to facilitate controlled lateral board movement concurrent with longitudinal movement of boards towards the trimmer. Each board is in contact with the ending rolls until the board has reached its optimized lateral position. The flexible fences act as a cushion and are contourable to a transition trajectory, or path, between successive flexible fences so as to keep boards close to, or in contact with, the surfaces of the fences at higher longitudinal translation speeds. The bi-directional cylinders controlling the positioning of the flexible fences may be mounted using cushioned mounts to help prevent the boards from bouncing off the fence surfaces.

In summary, a board positioning device selectively positions in a lateral direction in a generally horizontal plane a board translating in a longitudinal direction in the horizontal plane, wherein the board is aligned along its length in the lateral direction, the device including a selectively deformable flexible fence lying in the generally horizontal plane, a fence positioner for selectively deforming and positioning the flexible fence in the lateral direction in the generally horizontal plane so as to deform the flexible fence along a curved transition path to a board optimizing position as determined by an optimizer, wherein the board may be laterally selectively positioned into an optimized position relative to trimmer saws located downstream from the flexible fence in the longitudinal direction when the board is urged laterally against the flexible fence by lateral ending means, board disengaging means, cooperating with the flexible fence, for selective disengaging of the board from the lateral ending means.

The device may include a flexible fence including a plurality of cooperatively alignable adjacent flexible fences in a laterally staggered, generally longitudinally aligned array of flexible fences, each of the plurality of flexible fences having a corresponding fence positioner for selectively laterally positioning its corresponding flexible fence, wherein the array of flexible fences are collectively selectively deformable and positionable so as to define a smooth curved transition path extending along the length of the array of flexible fences for sliding translation thereover of an end of the board.

The board disengaging means may include a longitudinal array of independently actuable board lifts for selectively disengaging the board from the lateral urging by the lateral ending means at board disengaging positions correspondingly laterally aligned with the plurality of flexible fences in the array of flexible fences, whereby a plurality of longitudinally spaced apart boards may be translated in the longitudinal direction in simultaneous spaced apart sliding engagement with the array of flexible fences and, when a particular board is selectively positioned into the optimized position as determined by an optimizing solution for that board, a corresponding board lift may be independently selectively actuated to disengage that board from further lateral urging by the lateral ending means as that board is longitudinally translated into the trimmer saws.

The flexible fence may be an elongate flexible strip lying in a generally vertical plane when non-deformed. The elongate flexible strip is elongate in a generally longitudinal direction so as to remain in the horizontal plane. An upstream end of the elongate flexible strip is rigidly fixed relative to the fence positioner. The fence positioner may be a selectively actuable actuator resiliently mounted to a downstream end of the elongate flexible strip.

The lateral ending means may be ending rolls lying in the horizontal plane, and the board lifts may each include a laterally spaced apart array of rigid arms mounted to a selectively rotatable common shaft for selective rotation of the array of rigid arms from a lowered board-disengaged position to an elevated board-engaging position, wherein, in the elevated board-engaging position, the board slides in the longitudinal direction over upper surfaces of the array of rigid arms, disengaged from the ending rolls, under a longitudinal urging force of longitudinal translating means translating the board in the longitudinal direction.

The common shaft may extend laterally beneath the ending rolls. The longitudinal translating means may be lugged transfer chains wherein lugs on the lugged transfer chains are mounted to, so as to extend upwardly from, the lugged transfer chains translating in the longitudinal direction in the horizontal plane and so as to engage an upstream side of the board when the board is disengaged from the ending rolls and sliding over the upper surfaces of the array of rigid arms.

The longitudinal array of independently actuable board lifts cooperates with controlling means for sequentially rotating each common shaft corresponding to each array of rigid arms so as to disengage the board from the ending rolls at the board optimizing position and to maintain disengagement of the board from the ending rolls in the longitudinal direction downstream of the board optimizing position.

The plurality of flexible fences may include first and second flexible fences lying in the horizontal plane, the first flexible fence upstream of the second flexible fence, a downstream end of the first flexible fence longitudinally adjacent an upstream end of the second flexible fence. The downstream end of the first flexible fence is selectively positionable in the horizontal plane between first and second lateral positions, wherein the first lateral position is longitudinally aligned with the upstream end of the first flexible fence and the second lateral position is longitudinally aligned with the upstream end of the second flexible fence. When the downstream end of the first flexible fence is in the second lateral position, the first flexible fence is smoothly curved between the upstream and downstream ends and a downstream board-contacting surface of the first flexible fence is generally flush with an upstream board-contacting surface of the second flexible fence.

DETAILED DESCRIPTION OF THE PREFERRED EMBODIMENT

Figure 1:
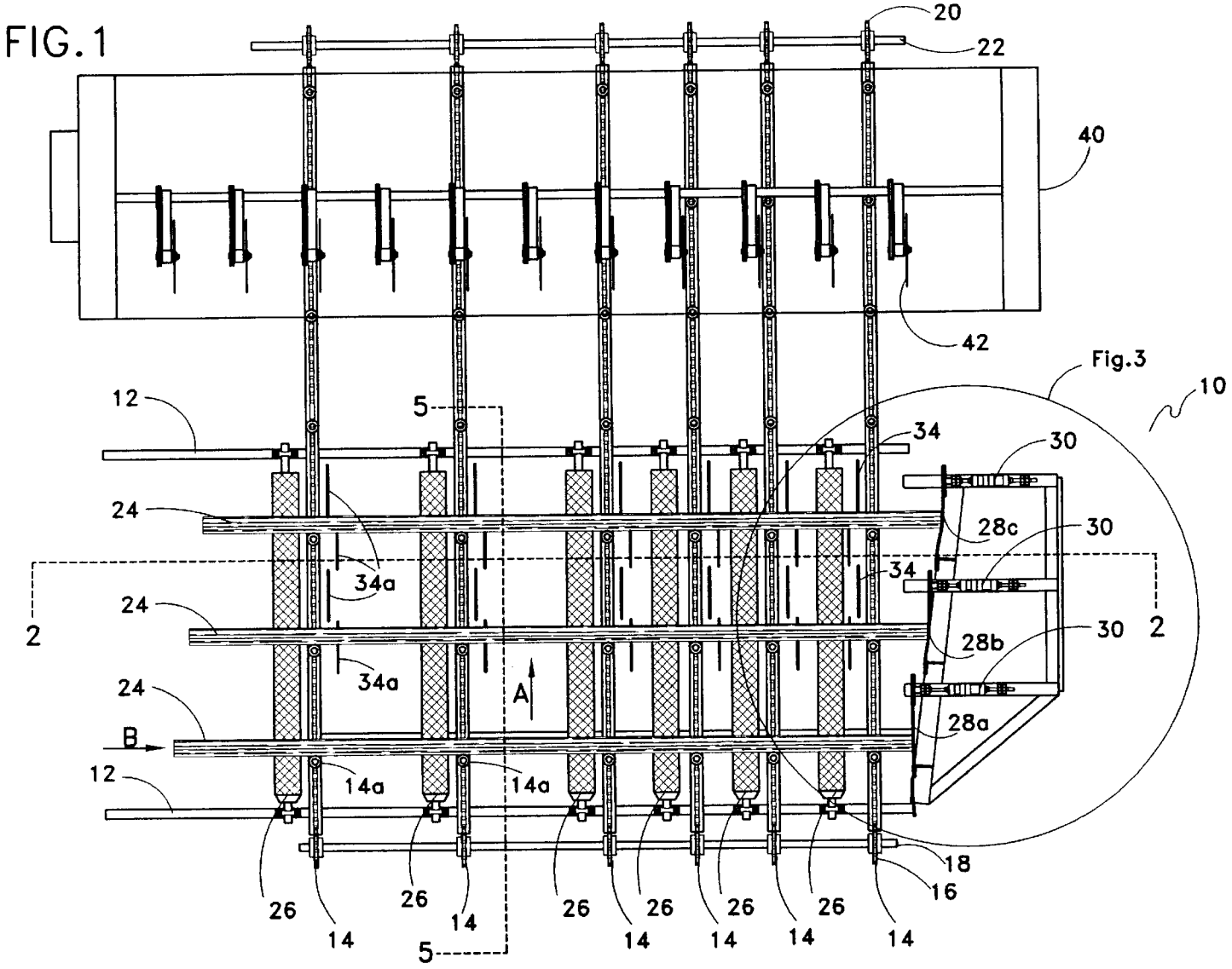
FIG. 1 is a plan view according to a preferred embodiment of the board positioning device of the present invention.
Figure 2:
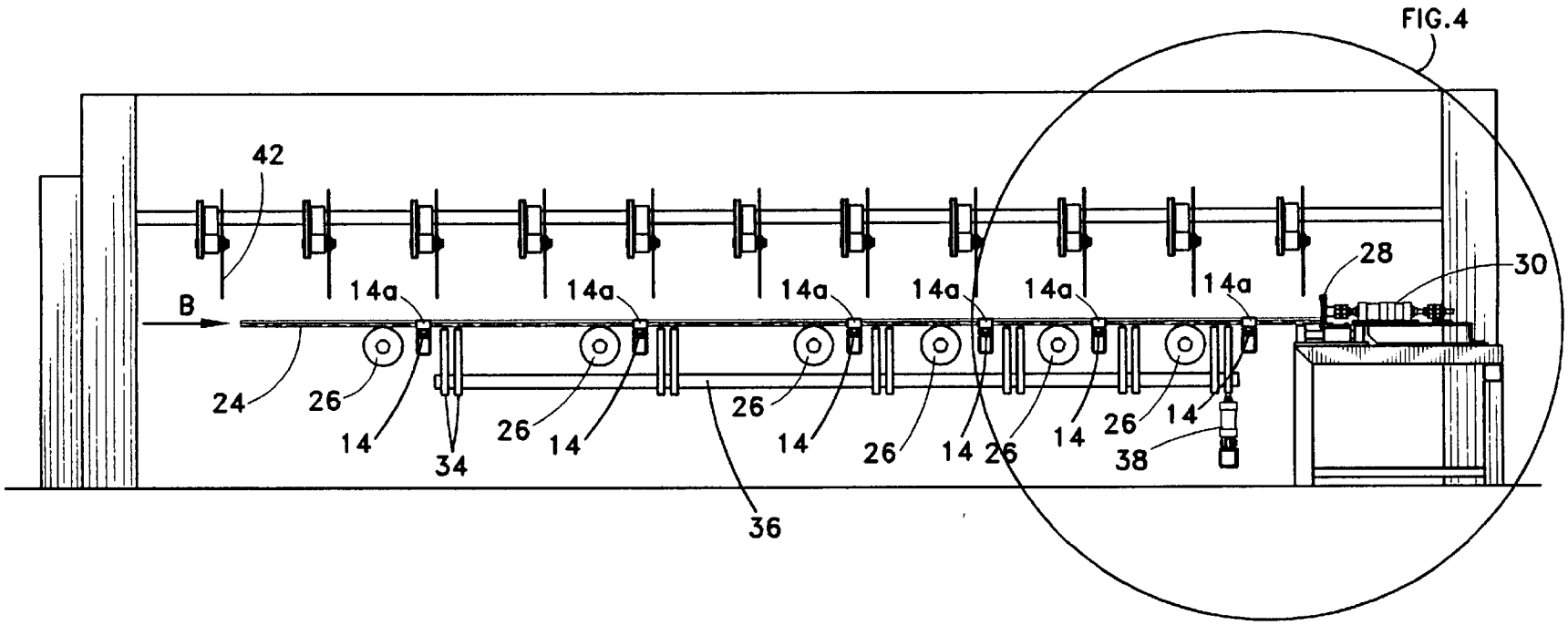
FIG. 2 is a cross-sectional view along section line 2—2 in FIG. 1.
Figure 3:
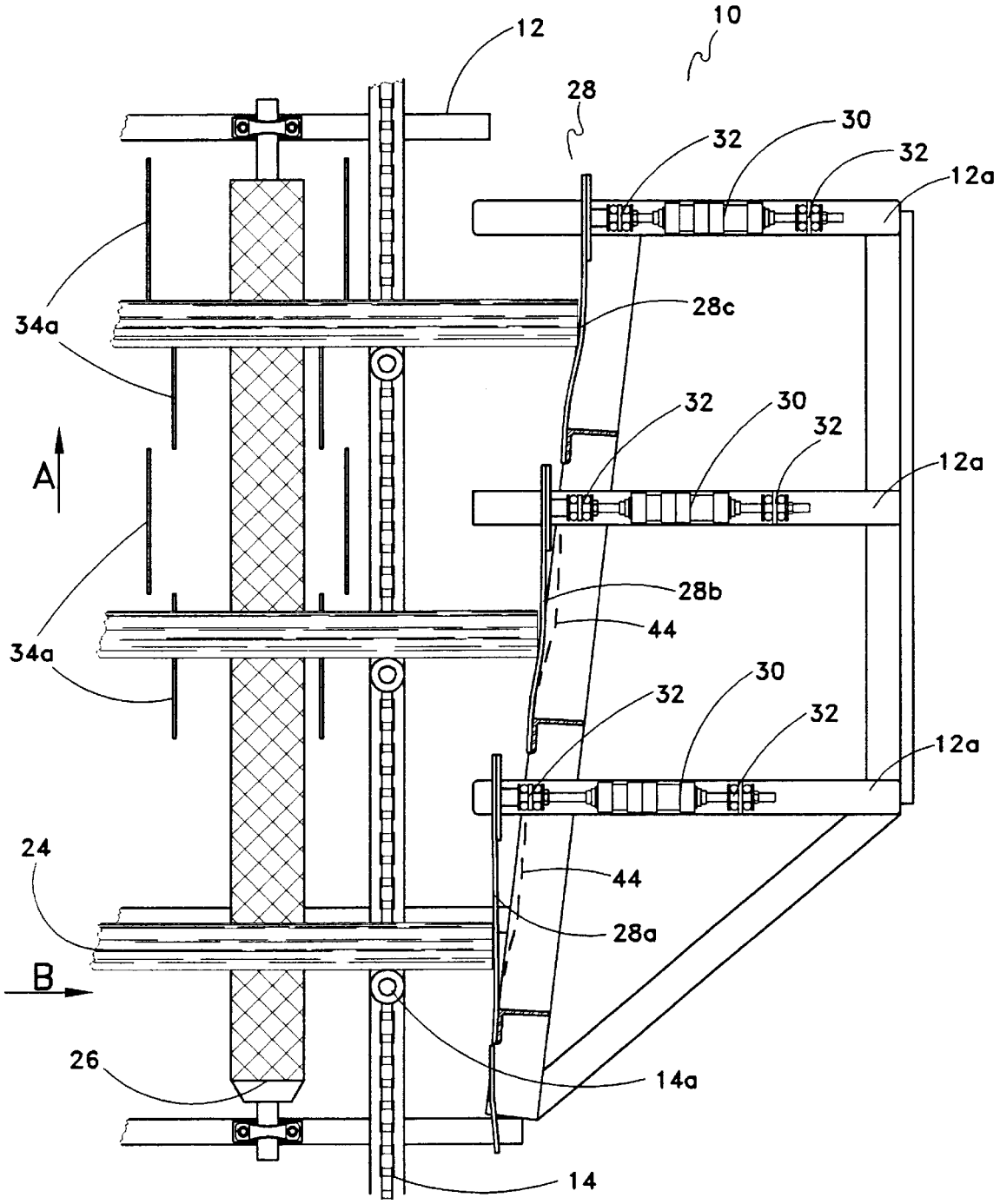
FIG. 3 is an enlarged, fragmentary view of the board positioning device of FIG. 1.
Figure 4:
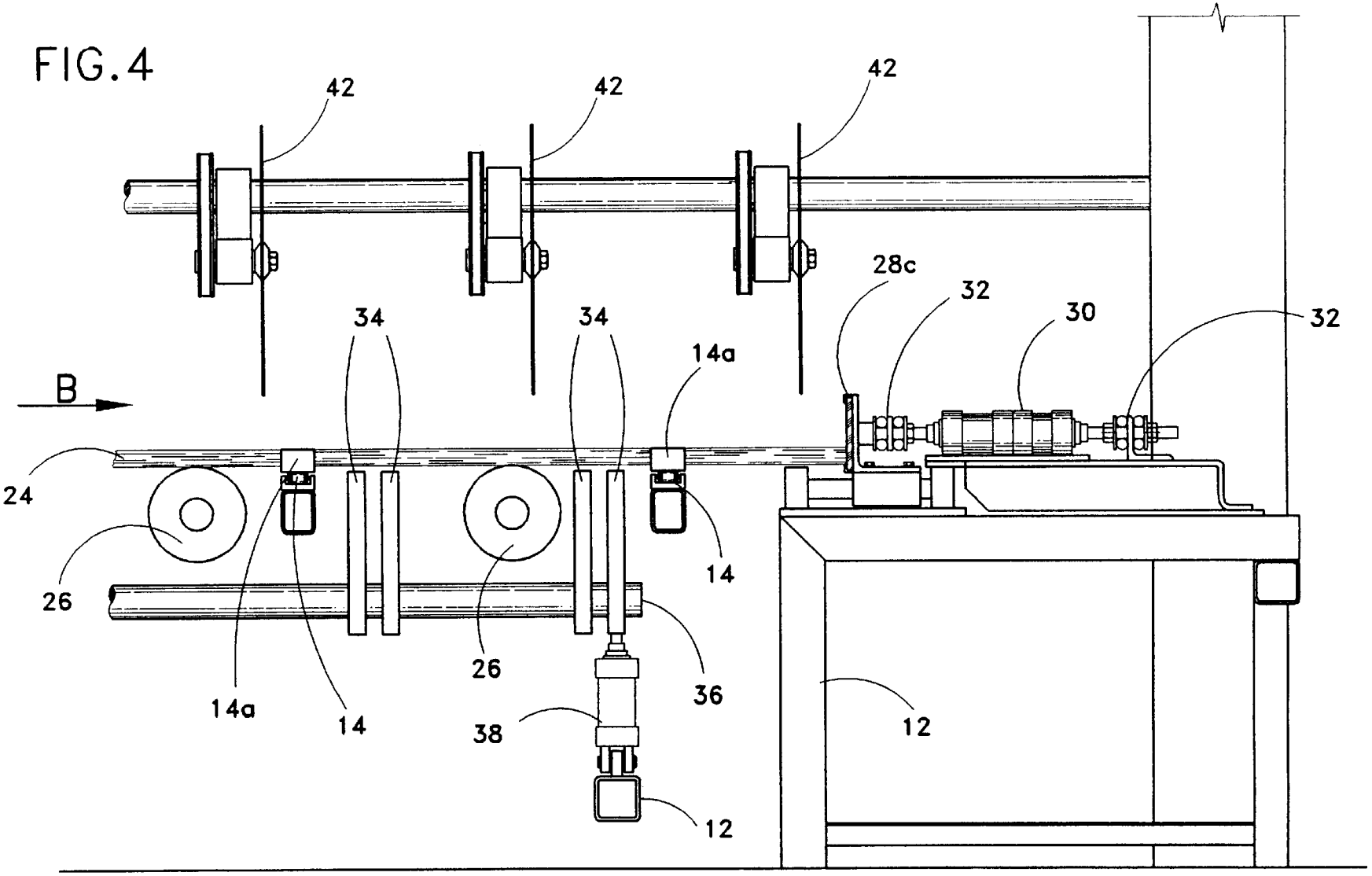
FIG. 4 is an enlarged, fragmentary, side sectional view of the board positioning device of FIG. 2.
Figure 5:
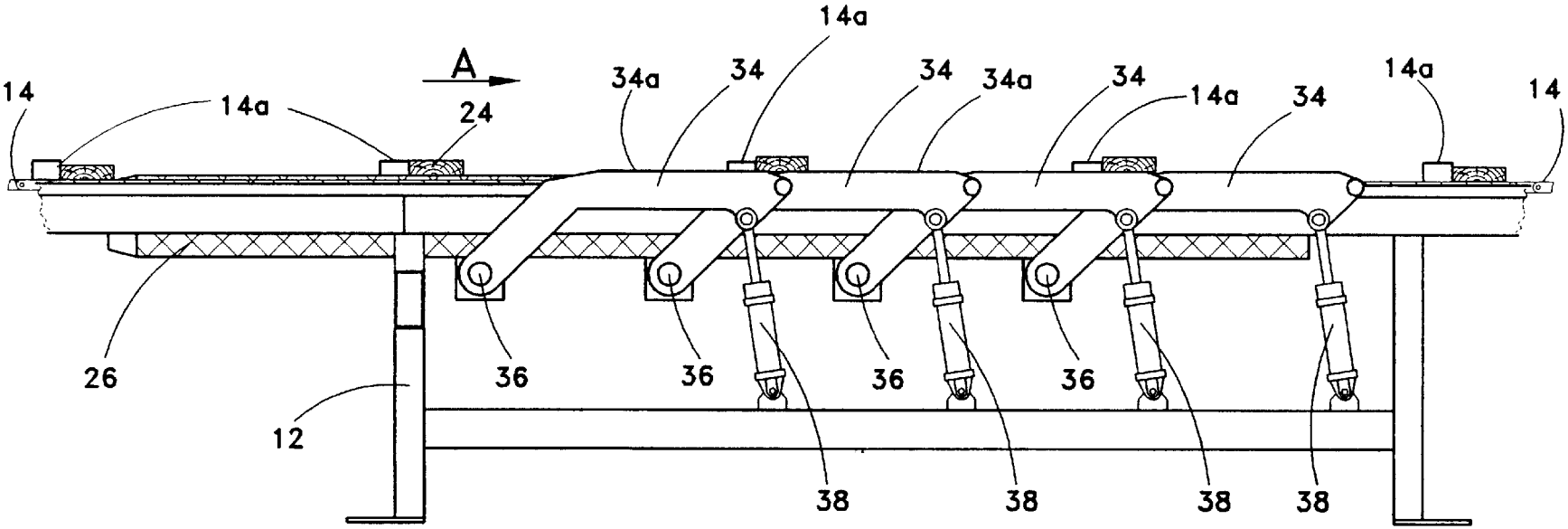
FIG. 5 is a cross-sectional view along section line 5—5 in FIG. 1, illustrating the lumber skids in their elevated position.
Figure 6:
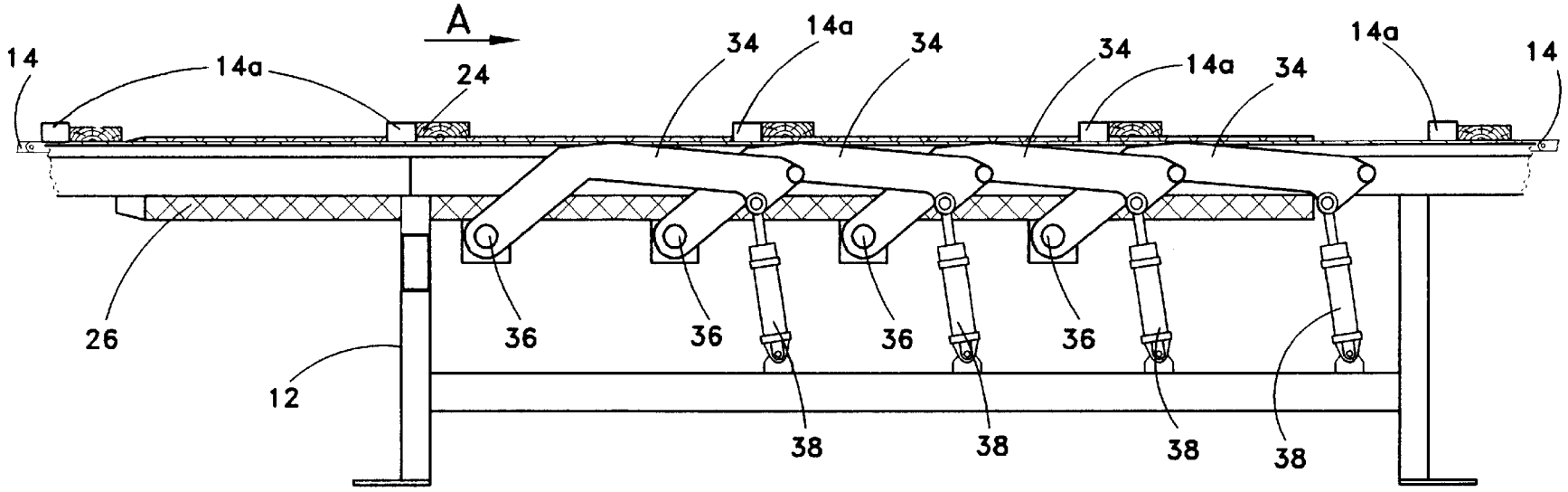
FIG. 6 is the cross-sectional view of FIG. 5 illustrating the lumber skids in their lowered position.

Referring to the drawing figures wherein similar characters of reference represent corresponding parts in each view, the apparatus of the present invention is generally indicated by the reference numeral 10 and is best seen in FIG. 1 and FIG. 3. The apparatus 10 includes a square tubular support frame constructed of various vertical and horizontal structural supports 12 and frame members 12*a,* a plurality of lugged transfer chains 14 mounted at their upstream end on transfer chain drive sprockets 16, where drive sprockets 16 are mounted on transfer chain drive shaft 18, and mounted at their downstream end on transfer chain idler sprockets 20, where idler sprockets 20 are mounted on transfer chain idler shaft 22. Transfer chains 14 transfer boards 24 over ending rolls 26. Ending rolls 26 rotate so as to urge boards 24 in direction B.

Flexible fences 28, and in particular three flexible fences 28*a,* 28*b,* 28*c* respectively, in the direction of flow, each are selectively actuably positioned by bi-directional cylinder 30. Bi-directional cylinders 30 are mounted to frame members 12*a* using cushioning material 32, such as the resilient rings illustrated. The cushioning material 32 is also used at the opposed ends of bi-directional cylinders 30, where bi-directional cylinders 30 are mounted to the flexible fences 28.

Boards 24 are lifted from ending rolls 26 by a plurality of lumber skids 34. Lumber skids 34 are aligned in laterally extending rows, perpendicular to lugged transfer chains 14. A longitudinally spaced apart parallel array of such rows is provided, spaced apart in the direction of flow of boards 24 on lugged transfer 14. Each row is mounted to a common shaft 36 as seen in FIGS. 2, 4, 5 and 6. Each lumber skid 34 is actuated by a selectively actuable bi-directional cylinder 38. Cylinders 38 are mounted to lumber skids 34 so as to rotate lumber skids 34 on common shafts 36 to thereby raise skid surfaces 34*a* of lumber skids 34 into sliding engagement with a board 24 being slid over the skid surface 34*a* by translation of lugs 14*a* in direction A on the transfer chain 14. Lugged transfer chains 14 translate boards 24 in direction A into trimmer 40, where trimmer saws 42 are actuated to trim boards 24.

In operation, boards 24 are translated in direction A, onto the ending rolls 26 by the lugged transfer chains 14. Lugs 14*a* may, as illustrated, include rollers on their contact surface so as to minimize resistance to translation of boards 24 in direction B on ending rolls 26. Ending rolls 26 are rotating with their upper surface rotating towards flexible fences 28. The fences 28 may commence their flexible deformation and positioning once a board 24 contacts the upstream end of flexible fence 28*a*. As board 24 moves in the direction of flow on transfer chain 14, ending rolls 26 continue to urge boards 24 laterally in direction B.

Upstream of lugged transfer chains 14, boards 24 have past through an electro-optical scanner. The electro-optical scanner has provided shape and flaw information to an information processor such as a computer programmed with optimizing algorithms which, based on the shape and flow information from the scanner, determine the optimized cutting solution for that particular board 24 in trimmer 40. The optimized lateral position of boards 24 relative to lugged transfer chains 14 and trimmer saws 42 is determined by the optimizing algorithms and converted by a controller into selectively actuable deformation and positioning of flexible fences 28. Each of flexible fences 28, that is, flexible fences 28*a*, 28*b*, and 28*c*, can be deformed in direction B by a deformation range dictated by the range of motion of the corresponding by-directional cylinder 30. Thus if a board 24 coming into contact with flexible fence 28*a* as that board 24 is translated downstream in direction A only has to be translated a direction B a distance falling within the range of motion of the bi-directional cylinder 30 corresponding to flexible fence 28*a* so as to position that board 24 in its optimized position according to the optimized cutting solution determined by the optimizing algorithms, then, once that board 24 has been optimally positioned by fence 28*a*, no further positioning in direction B is required. Thus, once positioned, that board 24 would be raised so as to be lifted from the influence of ending rolls 26 by sequentially elevating rows of lumber skids 34, sequentially in a downstream direction corresponding to the position of that board 24 as it is translated in direction A on lugged transfer chains 14.

If the amount of lateral translation required in direction B for a particular board 24 so as to position that board 24 in its optimized position for trimming as determined by the optimizing algorithm exceeds the range of movement of the bi-directional cylinder 30 corresponding to flexible fence 28*a*, then the bi-directional cylinder 30 corresponding to flexible fence 28*a* will be retracted so as to position the downstream end of flexible fence 28*a* flush with the upstream end of flexible fence 28*b* so that, as board 24 is translated in direction A on lugged transfer chains 14, the end of board 24 in contact with flexible fence 28*a* will smoothly slide from the downstream end of flexible fence 28*a* onto the upstream end of flexible fence 28*b*. Further lateral translation of board 24 in direction B will then be governed by the positioning of flexible fence 28*b* according to the position of its corresponding bi-directional cylinder 30. Thus, if the optimized position in direction B of board 24 lies within the combined range of movement of flexible fences 28*a* and 28*b*, then that optimized position will be attained at some point along flexible fence 28*b* as board 24 is translated in direction A on lugged transfer chains 14. Once the optimized position is attained, lumber skids 34 are elevated so as to remove that board 24 from the influence of ending rolls 26, that board 24 thereafter being translated in direction A on lugged transfer chains 14 in that board 24's optimized lateral position and so into trimmer saws 42 in its optimized position relative to trimmer saws 42 according to the instructions of the optimized algorithm.

If the optimized position in direction B of board 24 cannot be obtained within the combined range of motion of the bi-directional cylinders 30 corresponding to flexible fences 28*a* and 28*b*, then the bi-directional cylinder 30 corresponding to flexible fence 28*b* will be retracted so as to position the downstream end of flexible fence 28*b* flush with the upstream end of flexible fence 28*c*. Thus, board 24 may be translated in direction A on lugged transfer chains 14 while being urged in direction B by ending rolls 26 so as to keep board 24 in contact with the surface of flexible fences 28, and in particular flexible fence 28*c* until its optimized position in direction B is attained according to the positioning of flexible fence 28*c* as flexibly deformed by its corresponding bi-directional cylinder 30, whereupon lumber skids 34 are elevated to lift board 24 from the influence of ending rolls 26.

If lumber skids 34 have been actuated by cylinders 38 so as to lift a board 24 off ending rolls 26 or so as to keep a board 24 which has already been lifted, from contacting ending rolls 26, then once the board 24 has passed from a row of lumber skids 34 to the next successive downstream row of lumber skids 34, the upstream rows of lumber skids 34 are lowered by the retraction of cylinders 38 until next called on to lift a successive board 24 from ending rolls 26 or when next called on to keep a successive board 24 which has already been lifted from coming into contact with ending rolls 26. The use of lumber skids 34 prevents ending rolls 26 from exerting any further lateral force on boards 24.

Flexible fences 28 are returned to their extended positions, that is, with cylinders 30 extended, after each board 24 passes downstream in direction A, whereafter flexible fences may be once again positioned to provide an optimized transition path for the next board 24 to allow a soft transition of the board 24 as it is laterally positioned in direction B, as may be required for optimized trimming.

Cushioning material 32 may be any form of linear shock absorber, but as depicted are made up of resilient "O"-rings journalled on a piston-like member extending from the bi-directional cylinder 30, the piston-like member slidingly mounted, as for example telescopically, in sliding engagement with downstream ends of fences 28.

Flexible fences 28 may be of any sturdy flexible material such as strips of urethane or the like, so long as, when the downstream ends of fences 28 are selectively deformed and positioned by cylinders 30 according to positioning instructions from the optimizer positioning algorithms, fences 28 will deform along a curved transition path in a horizontal plane.

It is understood that the present invention is not necessarily restricted to, or requires, three longitudinally alignable flexible fences 28. The three fences 28*a,* 28*b,* and 28*c* in the embodiment illustrated may form just part of a generally longitudinally aligned array of flexible fences 28. In fact, such an array is aligned somewhat off from a longitudinal alignment as the purpose of the array of fences is to softly transition boards 24 laterally (ie. in direction B), by constraining their lateral movement to a transition path 44 (shown by way of illustration in dotted outline) against the lateral urging force in direction B of ending rolls 26.

When boards 24 are extremely fragile or are being translated longitudinally (ie. in direction A) at higher speeds, then, for a constant speed of rotation of ending rolls 26, a longer array of flexible fences 28 may be required, that is, either individually longer fences 28 or a greater number of fences 28 in the array, in order to accomplish the maximum lateral translation required to achieve an optimized lateral positioning of a board 24. The maximum lateral translation which may possibly be required will not be greater than the spacing between the trimmer saws 42, conventionally 2 feet. An example of a transition path 44 is illustrated in dotted outline in FIG. 3 for the situation where the optimizer positioning algorithm has determined that a particular board 24 must be translated a distance which requires positioning by flexible fence 28*c,* that is, the flexible fence 28 which is the furthest laterally offset from the ending rolls 26. Thus, that particular board 24 would be ended successively by ending rolls 26 against fences 28*a,* 28*b* and 28*c* and fences 28*a,* 28*b* positioned on trajectory 44 to allow the end of the board to smoothly slide from fence 28*a* to fence 28*b* and from fence 28*b* to fence 28*c*.

For situations where the trimmer saws 42 are spaced relatively closer together, so that boards may be laterally positioned within the freedom of movement of one flexible fence 28, or within the freedom of movement of two flexible fences cooperating in the manner described above, then three flexible fences 28 would not be required, but rather the one or two flexible fences.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A board positioning device for selectively positioning, in a lateral direction in a generally horizontal plane, relative to a laterally spaced array of trimmer saws, a board translating in a longitudinal direction on a lugged transfer chain in said horizontal plane, wherein said board is aligned along its length in said lateral direction, said device comprising:

a selectively deformable flexible fence, lying generally in said longitudinal direction in said generally horizontal plane, mounted to a supporting frame along a lateral edge of said lugged transfer chain, said flexible fence rigidly mounted to said supporting frame at a single upstream location along said flexible fence, thereby defining a downstream end, distal from said single upstream location, of said flexible fence, downstream relative to said translation of said board in said longitudinal direction on said lugged transfer chain, fence positioning means for selectively deforming and positioning said downstream end of said flexible fence in said lateral direction in said generally horizontal plane so as to deform said flexible fence along a curved transition path to a board optimizing position, said fence positioning means rigidly mounted to said supporting frame and to said downstream end, so as to extend between said supporting frame and said downstream end, board ending means for laterally urging and translating said board against said flexible fence when said flexible fence is selectively deformed and positioned in said board optimizing position, said board ending means mounted to said supporting frame so as to engage said board on said lugged transfer chain, board disengaging means mounted to said supporting frame for selective disengaging of said board from said board ending means while said board is being translated on said lugged transfer chain.

2. The board positioning device of claim 1 wherein said flexible fence comprises a plurality of cooperatively alignable adjacent flexible fences mounted to said supporting frame along generally said lateral edge of said lugged transfer chain in a laterally staggered, generally longitudinally aligned array of flexible fences, wherein said fence positioning means are selectively controllable actuators, wherein each flexible fence of said plurality of flexible fences has mounted at generally a downstream end thereof a corresponding said selectively controllable actuator, wherein said array of flexible fences are cooperatively selectively deformable and positionable relative to said lugged transfer chain by means of said selectively controllable actuators so as to define said curved transition path along said length of said array of flexible fences for sliding translation thereover of an end of said board into said board optimizing position.

3. The board positioning device of claim 2 wherein said board disengaging means comprises a longitudinal array of independently actuable board lifts for selectively disengaging said board from said lateral urging by said board ending means at board disengaging positions, said board disengaging positions correspondingly laterally aligned with said plurality of flexible fences in said array of flexible fences, whereby a plurality of longitudinally spaced apart boards may be translated in said longitudinal direction in simultaneous spaced apart sliding engagement with said array of flexible fences and, when a particular board is selectively positioned into said optimized position as determined by an optimizing solution for that board, a corresponding board lift may be independently selectively actuated by lift actuating means to disengage that board from further lateral urging by said board ending means as that board is longitudinally translated into said trimmer saws.

4. The board positioning device of claim 3 wherein each of said flexible fences of said plurality of flexible fences is an elongate flexible strip, lying in a generally vertical plane when non-deformed, elongate in generally said longitudinal direction so as to remain in said horizontal plane, and wherein an upstream end of each said elongate flexible strip is rigidly mounted to said supporting frame, and wherein each of said selectively controllable actuators is mounted at one end of said actuator to a corresponding downstream end of a corresponding said elongate flexible strip, and resiliently mounted at an opposite end of said actuator to said supporting frame.

5. The board positioning device of claim 4 wherein said hoard ending means are ending rolls lying in said horizontal plane, and said board lifts each include a laterally spaced apart array of rigid arms mounted to a selectively rotatable common shaft for selective rotation of said array of rigid arms from a lowered board-disengaged position to an elevated board-engaging position, wherein in said elevated board-engaging position said board slides in said longitudinal direction over upper surfaces of said array of rigid arms, disengaged from said ending rolls, under a longitudinal urging force of said lugged transfer chain translating said board in said longitudinal direction.

6. The board positioning device of claim 5 wherein said common shaft extends laterally beneath said ending rolls, and wherein lugs on said lugged transfer chain are mounted to, so as to extend upwardly from, said lugged transfer chain and so as to engage an upstream side of said board when said board is disengaged from said ending rolls and sliding over said upper surfaces of said array of rigid arms.

7. The board positioning device of claim 6 wherein said longitudinal array of independently actuable board lifts are mounted on a corresponding longitudinal array of said common shafts, wherein said array of said common shafts cooperate with controlling means for sequentially rotating each of said common shafts in said array of common shafts so as to disengage said board from said ending rolls at said board optimizing position and to maintain disengagement of said board from said ending rolls in said longitudinal direction downstream of said board optimizing position.

8. The board positioning device of claim 2 wherein said board disengaging means comprises a longitudinal array of independently actuable board lifts for selectively disengaging said board from said lateral urging by said board ending means at board disengaging positions correspondingly laterally aligned with said plurality of flexible fences in said array of flexible fences, whereby a plurality of longitudinally spaced apart boards may be translated in said longitudinal direction in simultaneous spaced apart sliding engagement with said array of flexible fences and, when a particular board is selectively positioned into said board optimizing position as determined by an optimizing solution for that board, a corresponding board lift may be independently selectively actuated to disengage that board from further lateral urging by said board ending means as that board is longitudinally translated into said trimmer saws on said lugged transfer chain.

9. The board positioning device of claim 8 wherein each of said flexible fences in said plurality of flexible fences is an elongate flexible strip lying in a generally vertical plane when non-deformed and mounted to said supporting frame and said fence positioning means, each of said elongate flexible strips elongate in a generally longitudinal direction so as to remain in said horizontal plane, and wherein an upstream end of each of said elongate flexible strips is rigidly mounted to said supporting frame, and wherein said fence positioning means is a selectively actuable actuator mounted at one end of said actuator to a downstream end of said elongate flexible strip, and resiliently mounted at an opposite end of said actuator to said supporting frame.

10. The board positioning device of claim 9 wherein said board ending means are ending rolls lying in said horizontal plane, and said board lifts each include a laterally spaced apart array of rigid arms mounted to a selectively rotatable common shaft for selective rotation of said array of rigid arms from a lowered board-disengaged position to an elevated board-engaging position, wherein in said elevated board-engaging position said board slides in said longitudinal direction over upper surfaces of said array of rigid arms, disengaged from said ending rolls, under a longitudinal urging force of said lugged transfer chain translating said board in said longitudinal direction.

11. The board positioning device of claim 10 wherein said common shaft extends laterally beneath said ending rolls, and wherein lugs on said lugged transfer chain are mounted to, so as to extend upwardly from, said lugged transfer chain and so as to engage an upstream side of said board when said board is disengaged from said ending rolls and sliding over said upper surfaces of said array of rigid arms.

12. The board positioning device of claim 11 wherein said longitudinal array of independently actuable board lifts cooperate with controlling means for sequentially rotating each said common shaft in each said array of rigid arms so as to disengage said board from said ending rolls at said board optimizing position and to maintain disengagement of said board from said ending rolls in said longitudinal direction downstream of said board optimizing position.

13. The board positioning device of claim 2 wherein said plurality of flexible fences comprises first and second flexible fences lying in said horizontal plane, said first flexible fence upstream of said second flexible fence, a downstream end of said first flexible fence longitudinally adjacent an upstream end of said second flexible fence, a first fence positioning means of said corresponding fence positioning means mounted to said first flexible fence at said downstream end of said first flexible fence so that said downstream end of said first flexible fence is selectively positionable in said horizontal plane between first and second lateral positions wherein said first lateral position is longitudinally aligned with said upstream end of said first flexible fence and said second lateral position is longitudinally aligned with said upstream end of said second flexible fence, and wherein when said downstream end of said first flexible fence is in said second lateral position said first flexible fence is smoothly curved between said upstream and downstream ends and a downstream board-contacting surface of said first flexible fence is generally flush with an upstream board-contacting surface of said second flexible fence.

* * * * *